US009071017B2

(12) United States Patent
Shimizu et al.

(10) Patent No.: US 9,071,017 B2
(45) Date of Patent: Jun. 30, 2015

(54) LEVER CONNECTOR

(71) Applicant: YAZAKI CORPORATION, Minato-ku, Tokyo (JP)

(72) Inventors: Tomohiko Shimizu, Shizuoka (JP); Akinori Tashiro, Shizuoka (JP); Akihiro Tsuruta, Shizuoka (JP); Kazuya Terao, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/134,134

(22) Filed: Dec. 19, 2013

(65) Prior Publication Data

US 2014/0106600 A1 Apr. 17, 2014

Related U.S. Application Data

(63) Continuation of application No. PCT/JP2012/066644, filed on Jun. 29, 2012.

(30) Foreign Application Priority Data

Jul. 1, 2011 (JP) ..... 2011-147249

(51) Int. Cl.
*H01R 13/627* (2006.01)
*H01R 13/629* (2006.01)
*H01R 13/74* (2006.01)

(52) U.S. Cl.
CPC ..... *H01R 13/6275* (2013.01); *H01R 13/62933* (2013.01); *H01R 13/741* (2013.01)

(58) Field of Classification Search
CPC ..... H01R 13/62938; H01R 13/62933; H01R 13/62977; H01R 13/741; H01R 13/64; H01R 13/74
USPC ..... 439/310, 152, 157, 159–160, 350, 357, 439/372
See application file for complete search history.

(56) References Cited

U.S. PATENT DOCUMENTS 4,875,873 A * 10/1989 Ishizuka et al. ..... 439/347
5,230,635 A * 7/1993 Takenouchi et al. ..... 439/157

(Continued)

FOREIGN PATENT DOCUMENTS

JP 2002-359037 A 12/2002
JP 2003-282182 A 10/2003

(Continued)

OTHER PUBLICATIONS

Japanese office action letter issued on Mar. 3, 2015 in the counterpart Japanese application.

(Continued)

*Primary Examiner* — Edwin A. Leon
(74) *Attorney, Agent, or Firm* — Marvin A. Motsenbocker; Mots Law, PLLC

(57) ABSTRACT

A lever connector includes a female connector, a male connector and a lever. The female connector includes a frame having a flange portion protruding toward a straight direction perpendicular to a direction in which the female connector and the male connector are to be fitted with each other. The flange portion includes a locking portion with flexibility. The lever includes a locked portion locked with the locking portion in a normal fitted state. The locking portion does not abut on a hole edge of an attachment hole formed on a panel in a state where the locked portion is locked with the locking portion, and abuts on the hole edge of the attachment hole in a state where the locked portion is not locked with the locking portion.

3 Claims, 5 Drawing Sheets

(56) References Cited

U.S. PATENT DOCUMENTS

| | | | | |
|---|---|---|---|---|
| 5,263,871 | A * | 11/1993 | Sano | 439/157 |
| 6,065,983 | A * | 5/2000 | Norizuki et al. | 439/157 |
| 7,637,757 | B2 * | 12/2009 | Matsumura et al. | 439/157 |
| 8,033,844 | B2 * | 10/2011 | Kobayashi et al. | 439/157 |
| 2004/0077197 | A1 * | 4/2004 | Nishide | 439/157 |

FOREIGN PATENT DOCUMENTS

| | | | |
|---|---|---|---|
| JP | 2003-282183 | A | 10/2003 |
| JP | 2008-027787 | A | 2/2008 |
| JP | 2009-135071 | A | 6/2009 |
| JP | 2011-081951 | A | 4/2011 |

OTHER PUBLICATIONS

Korean office action letter issued on Mar. 19, 2015 in the counterpart Korean patent application.

* cited by examiner

LEVER CONNECTOR

CROSS REFERENCE TO RELATED APPLICATION

This is a continuation application based on PCT application No. PCT/JP2012/066644 filed on Jun. 29, 2012, which claims the benefit of priority from Japanese Patent Application No. 2011-147249 filed on Jul. 1, 2011, the entire contents of which are incorporated by reference herein.

BACKGROUND OF THE INVENTION

1. Field of the Invention

The present invention relates to a lever connector to be attached to a panel.

2. Description of the Related Art

A conventional lever connector to be attached to a panel includes a female connector (first connector), a male connector (second connector) to be fitted with the female connector, and a lever which is provided to the male connector and causes both connectors to be fitted with each other by rotation thereof. The lever connector is attached to an attachment hole formed on the panel in a state where both connectors are fitted with each other.

In such a lever connector, an interference portion which can interfere with a hole edge of the attachment hole of the panel, is formed on a side surface which is located at a rear surface side in a rotation direction of the lever (for example, see Patent Literature 1: Japanese Patent Application Laid-Open Publication No. 2002-359037). The interference portion does not interfere with the hole edge of the attachment hole of the panel when both connectors have a normal fitted state, and interferes with the hole edge of the attachment hole when both connectors have a partial fitted state. Thereby, in a process of attaching both connectors to the attachment hole of the panel, it is possible to detect a fitted state of both connectors by determining whether or not the interference portion interferes with the hole edge of the attachment hole.

However, in the above-described conventional lever connector, since the interference portion is formed on the side surface which is located at the rear surface side in the rotation direction of the lever, a degree of interference between the interference portion and the hole edge of the attachment hole becomes small when the lever approaches a horizontal direction with respect to a direction in which both connectors are fitted with each other. This makes it difficult to detect the partial fitted state even if both connectors actually have the partial fitted state. In addition, in order to improve the detection of the partial fitted state, it is considered to extend the interference portion outward with respect to the rotation direction of the lever. However, this has a possibility that the lever connector has a large size.

SUMMARY OF THE INVENTION

In view of the above, the present invention has an object to provide a lever connector capable of surely detecting a fitted state of a first connector and a second connector.

According to an aspect of the present invention, a lever connector to be attached to an attachment hole formed on a panel, including: a first connector; a second connector to be fitted with the first connector; and a lever that is provided to one of the first connector and the second connector and causes the first connector and the second connector to be fitted with each other by rotation thereof, wherein the lever connector is attached to the attachment hole formed on the panel in a state where the first connector and the second connector are fitted with each other, the first connector includes a housing and a frame that surrounds the housing, the frame includes a body portion and a flange portion that is provided to one edge of the body portion and protrudes toward a straight direction perpendicular to a direction in which the first connector and the second connector are to be fitted with each other, the flange portion is provided with a front surface located at a side of the body portion and includes a locking portion with flexibility, the lever includes a locked portion locked with the locking portion in a normal fitted state of the first connector and the second connector, and the locking portion does not abut on a hole edge of the attachment hole in a state where the locked portion is locked with the locking portion, and abuts on the hole edge of the attachment hole in a state where the locked portion is not locked with the locking portion.

According to this aspect, the flange portion is provided to one edge of the body portion. Thereby, it is not necessary to provide an interference portion to the lever like a conventional one. Such an interference portion does not extend outward with respect to the rotation direction of the lever, which suppresses the increase of the size of the lever connector.

The locking portion does not abut on the hole edge of the attachment hole in the state where the locked portion is locked with the locking portion, and abuts on the hole edge of the attachment hole in the state where the locked portion is not locked with the locking portion. That is, the locking portion does not abut on the hole edge of the attachment hole in a normal fitted state of the first connector and the second connector, and abuts on the hole edge of the attachment hole in a partial fitted state of the first connector and the second connector. Thus, it is possible to detect the partial fitted state of the first connector and the second connector, that is, it is possible to surely detect a fitted state of the first connector and the second connector.

According to an aspect of the present invention, the locking portion includes: a protruding part that protrudes toward a direction away from a side of the front surface of the flange portion; and a bending part that bends inward with respect to a rotation direction of the lever from a distal end of the protruding part, and an insertion hole in which the bending part is to be inserted is formed on the locked portion.

According to this aspect, the bending part is inserted in the insertion hole of the lever. Thereby, the locked portion is surely locked with the locking portion in the normal fitted state of the first connector and the second connector. The locking portion is not inserted into the locked portion in the partial fitted state of the first connector and the second connector. Thus, it is possible to surely detect a fitted state of the first connector and the second connector.

According to an aspect of the present invention, the flange portion includes an abutment portion that abuts on the hole edge of the attachment hole in a partial fitted state of the first connector and the second connector, and the abutment portion is provided at a position different from a position at which the locking portion is provided.

According to this aspect, the abutment portion is provided at the position different from that at which the locking portion is provided. Thereby, in addition to the detection of the partial fitted state of the first connector and the second connector by the abutment on the hole edge of the attachment hole in the locking portion, it is also possible to detect the partial fitted state of the first connector and the second connector by the abutment on the hole edge of the attachment hole in the abutment portion.

According to the present invention, it is possible to provide a lever connector capable of surely detecting a fitted state of a first connector and a second connector while suppressing the increase of the size thereof.

DESCRIPTION OF THE EMBODIMENTS

Figure 1:
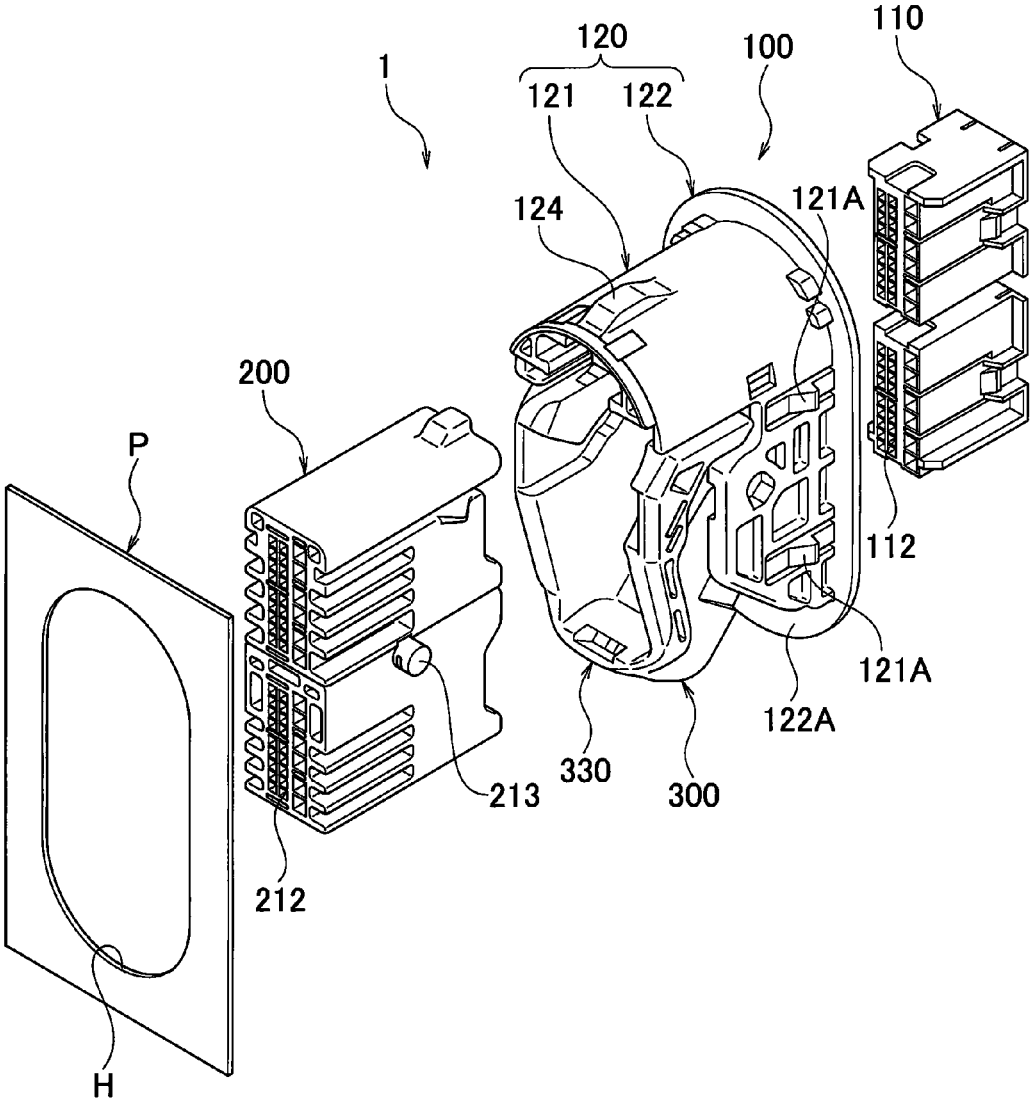
FIG. 1 is an exploded perspective view of a lever connector according to an exemplary embodiment of the present invention.

Next, an exemplary embodiment of the lever connector according to the present invention will be described with reference to the drawings. Specifically, description will be made about (1) a structure of a lever connector 1, (2) an explanation of a fitted state of a female connector 100 and a male connector 200, (3) operations and effects, and (4) other embodiments.

Further, in description of the following drawings, same or similar reference numerals or sings will be assigned to same or similar portions. It is noted that since the drawings are schematic, ratios and the like of respective dimensions are different from those of actual ones.

Thus, specific dimensions and the like should be determined in view of the following explanations. Further, in the drawings, portions having different dimensional relations or different dimensional ratios are included.

(1) Structure of Lever Connector 1

Figure 2:
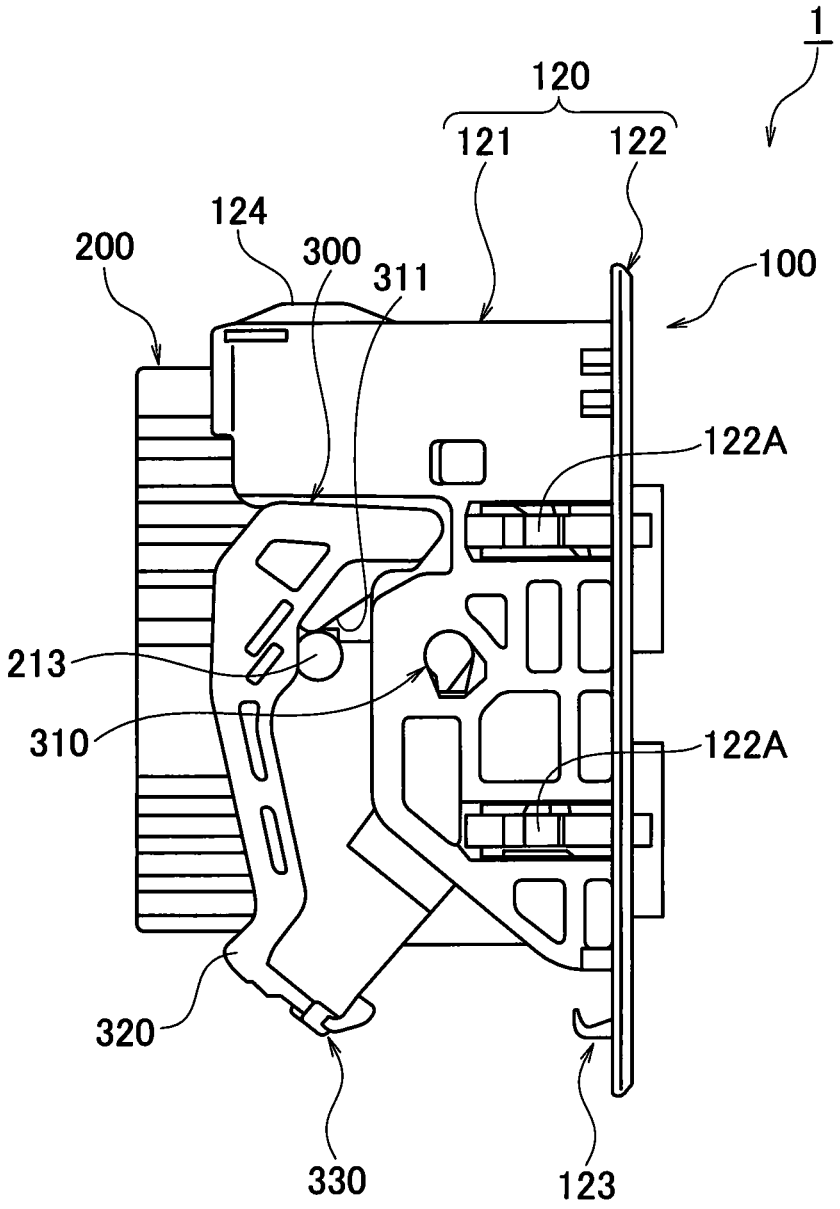
FIG. 2 is a side view of the lever connector according to the exemplary embodiment of the present invention.
Figure 3:
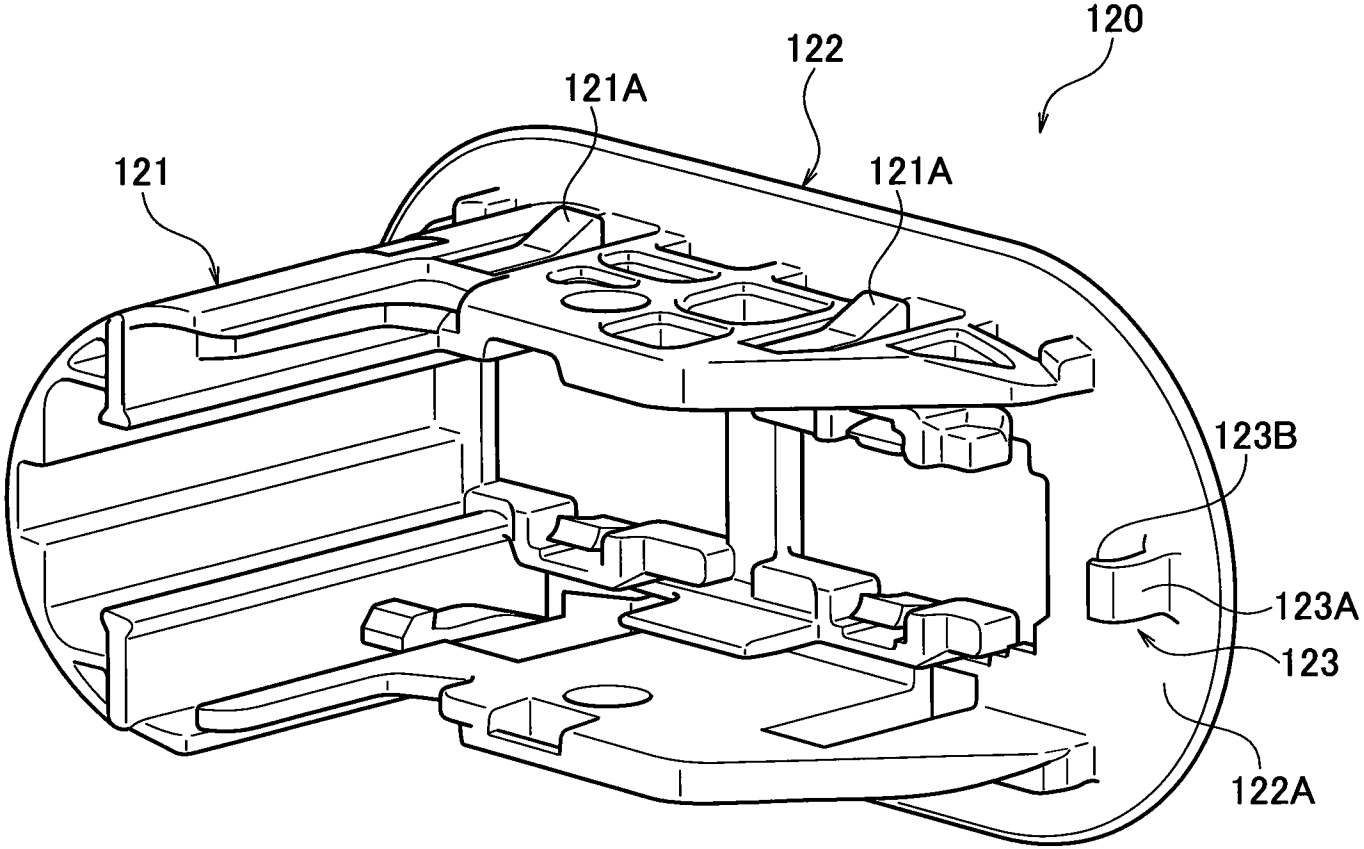
FIG. 3 is a perspective view of a frame according to the exemplary embodiment of the present invention.

First, the structure of the lever connector 1 according to the present embodiment will be described with reference to the drawings. FIG. 1 is an exploded perspective view of the lever connector 1 according to the present embodiment. FIG. 2 is a side view of the lever connector 1 according to the present embodiment. FIG. 3 is a perspective view of a frame 120 according to the present embodiment.

As shown in FIGS. 1 and 2, the lever connector 1 includes the female connector 100 (first connector), a male connector 200 (second connector) to be fitted with the female connector 100, and a lever 300 which is provided to the female connector 100 and causes the female connector 100 and the male connector 200 to be fitted with each other by rotation thereof. The lever connector 1 is attached to an attachment hole H formed on a panel P in a state where the female connector 100 and the male connector 200 are fitted with each other.

The female connector 100 includes an inner housing 110 and a frame 120 surrounding the inner housing 110. The inner housing 110 has a double-decker structure in which two housing members are stacked in a vertical direction. In the inner housing 110, terminal receiving chambers 112 for receiving female terminals 111 (see FIGS. 4A, 4B, 5A and 5B) are formed to extend along a direction in which the female connector 100 and the male connector 200 are to be fitted with each other. Electric cables (not shown) to be connected to the female terminals 111 are introduced from a rear side (a right side in the drawing) of the terminal receiving chambers 112. The inner housing 110 is received in the frame 120.

The frame 120 includes a body portion 121 to which the lever 300 is provided, and a flange portion 122 which is provided to one edge of the body portion 121 and protrudes toward a straight direction perpendicular to the direction in which the female connector 100 and the male connector 200 are to be fitted with each other.

The female connector 100 is provided with the body portion 121. The male connector 200 is fitted with the female connector 100, which allows the body portion 121 to receive the female connector 100 and the male connector 200 therein. A plurality of panel locks 121A to be engaged with the attachment hole H formed on the panel P, is formed on the body portion 121. The body portion 121 is formed to be integrated with the flange portion 122.

The flange portion 122 largely protrudes toward the straight direction beyond the attachment hole H formed on the panel P. The flange portion 122 is formed to surround the attachment hole H when the frame 120 is attached to the attachment hole H.

As shown in FIG. 3, the flange portion 122 includes a locking portion 123 with flexibility provided on a front surface 122A located at a side of the body portion 121. The locking portion 123 has a hook-like shape. Specifically, the locking portion 123 includes a protruding part 123A which protrudes toward a direction away from a side of the front surface 122A of the flange portion 122, and a bending part 123B which bends toward an inward direction with respect to a rotation direction of the lever 300 from a distal end of the protruding part 123A.

It is noted that the inward direction with respect to the rotation direction of the lever 300 means an inward direction with respect to a trajectory drawn by the rotation of the lever 300. That is, it is noted that the inward direction with respect to the rotation direction of the lever 300 is a direction from the trajectory drawn by the rotation of the lever 300 toward a shaft support part 310, and an outward direction with respect to the rotation direction of the lever 300 is a direction from the trajectory drawn by the rotation of the lever 300 toward the outside.

The locking portion 123 is formed at a position corresponding to the hole edge of the attachment hole H in the normal fitted state of the female connector 100 and the male connector 200. The locking portion 123 does not abut on the hole edge of the attachment hole H in the normal fitted state of the female connector 100 and the male connector 200, and abuts on the hole edge of the attachment hole H in the partial fitted state of the female connector 100 and the male connector 200. The locking portion 123 abuts on a locked portion 330 of the lever 300 in the last half of a rotation operation of the lever 300, and then the locked portion 330 is locked with the locking portion 123 at the end of the rotation operation of the lever 300.

The flange portion 122 includes an abutment portion 124 which abuts on the hole edge of the attachment hole H in the partial fitted state of the female connector 100 and the male connector 200. The abutment portion 124 is provided at a position different from one where the locking portion 123 is provided. In the present embodiment, the abutment portion 124 is provided on an upper face of the flange portion 122.

The male connector 200 has a double-decker structure in which two housing members are stacked in a vertical direction, which is larger than the inner housing 110. In the male connector 200, terminal receiving chambers 212 for receiving male terminals 211 (see FIGS. 4A, 4B, 5A and 5B) to be connected to the female terminals 111, is formed to extend along the direction in which the female connector 100 and the male connector 200 are to be fitted with each other. Electric cables (not shown) to be connected to the male terminals 211 are introduced from a rear side (a left side in the drawing) of the terminal receiving chambers 212.

Cam followers 213 to be inserted in cam grooves 311 of the lever 300, are respectively provided in a protruding manner on both side surfaces of the male connector 200. The cam followers 213 are inserted in the cam grooves 311, and then the male connector 200 is fitted with the inner housing 110 by the rotation of the lever 300. Thereby, the female terminals 111 and the male terminals 211 are connected to each other.

The lever 300 is rotatably mounted to the frame 120 via the shaft support parts 310 respectively provided on both side surfaces thereof. The lever 300 is rotated by pressure-operating an operation portion 320 in a state where the cam followers 213 of the male connector 200 are inserted in the cam grooves 311, that is in the partial fitted state of the female connector 100 and the male connector 200. Then, the lever 300 causes the female connector 100 and the male connector 200 to be in the normal fitted state using an action of leverage. The lever 300 includes the locked portion 330 to be locked with the locking portion 123 of the frame 120.

The locked portion 330 is locked with the locking portion 123 in the normal fitted state of the female connector 100 and the male connector 200. In the locked portion 330, an insertion hole 331 in which the locking portion 123 (bending part 123B) is to be inserted is formed. The locked portion 330 has an inclined face inclining from the top thereof.

The locked portion 330 bends the locking portion 123 in the outward direction with respect to the rotation direction of the lever 300 when abuts on the locking portion 123 by the rotation operation of the lever 300. When the rotation operation of the lever 300 is further continued from this state, the locking portion 123 gets over the locked portion 330 and is restored in the inward direction with respect to the rotation direction of the lever 300. This allows the locked portion 330 to be locked with the locking portion 123. The engagement of the locking portion 123 and the locked portion 330 keeps the normal fitted state of the female connector 100 and the male connector 200.

(2) Explanation of Fitted State of the Female Connector 100 and the Male Connector 200

Figure 4B:
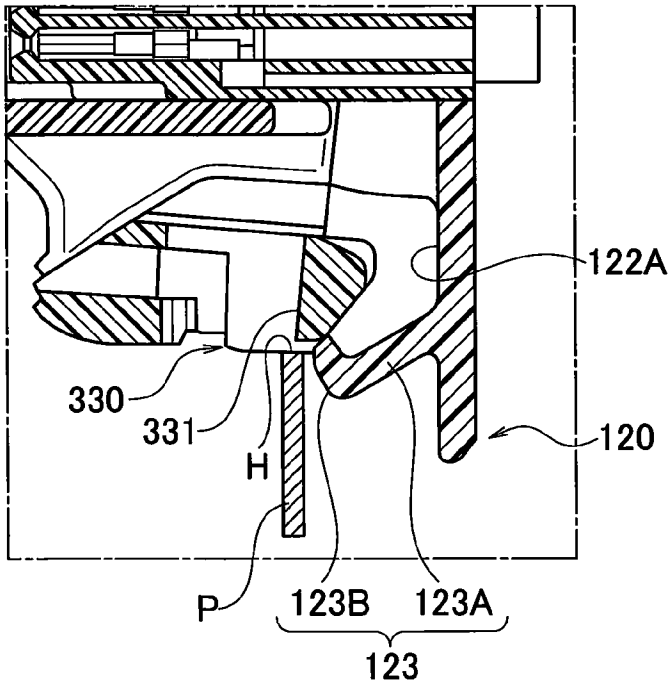
FIG. 4B is an enlarged view that illustrates an area IVB in the vicinity of a locking portion and a locked portion in FIG. 4A.
Figure 4A:
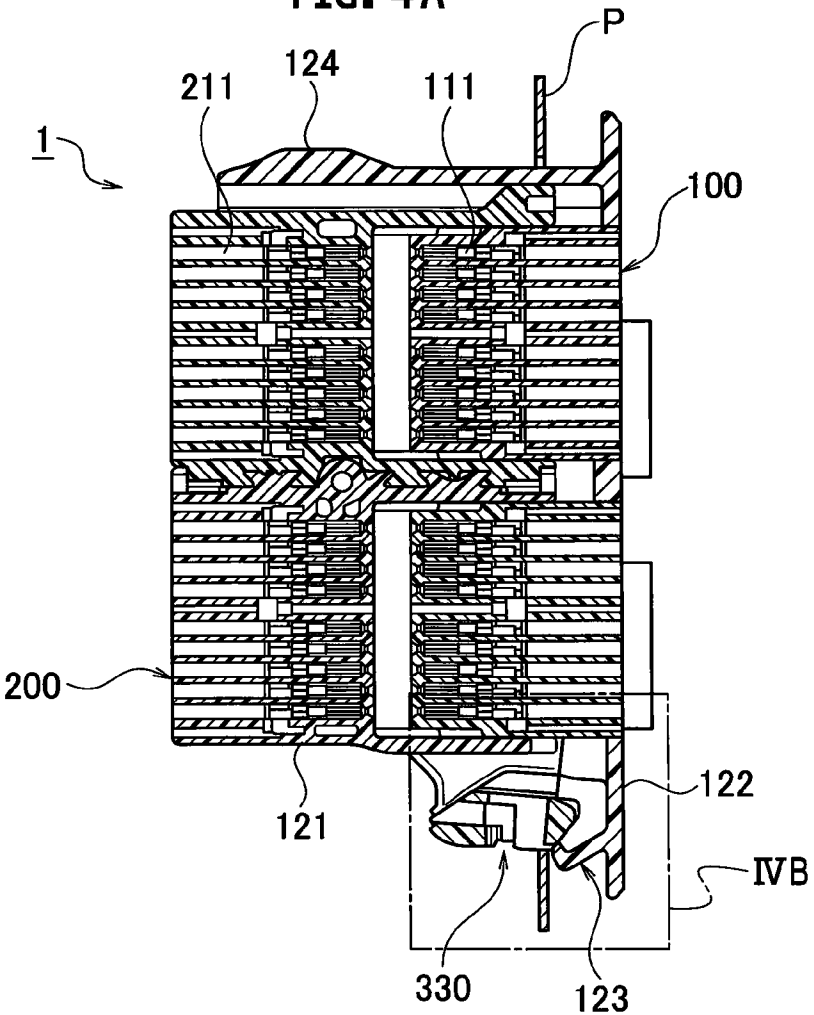
FIG. 4A is a cross-sectional view that illustrates a partial fitted state of a female connector and a male connector in the lever connector according to the exemplary embodiment of the present invention.

Next, a fitted state of the female connector 100 and the male connector 200 will be described with reference to FIGS. 4A, 4B, 5A and 5B. FIG. 4A is a cross-sectional view that illustrates the partial fitted state of the female connector 100 and the male connector 200 in the lever connector 1 according to the present embodiment. FIG. 4B is an enlarged view that illustrates an area IVB in the vicinity of the locking portion 123 and the locked portion 330 in FIG. 4A.

Figure 5B:
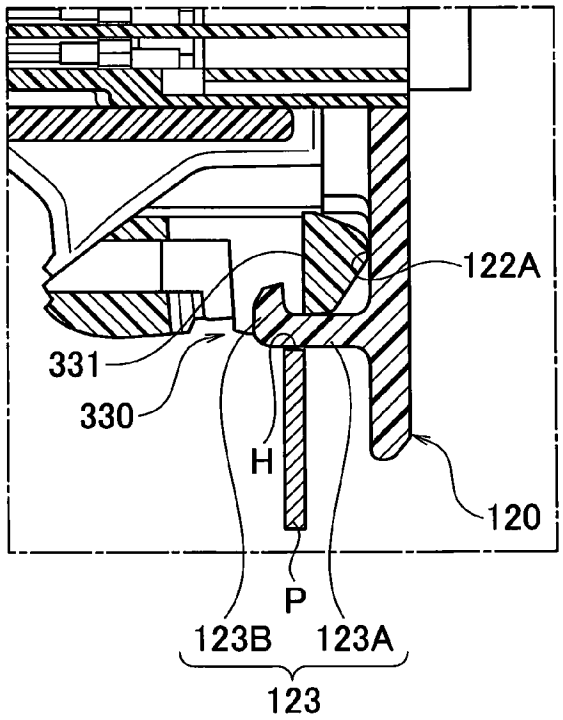
FIG. 5B is an enlarged view that illustrates an area VB in the vicinity of the locking portion and the locked portion in FIG. 5A.
Figure 5A:
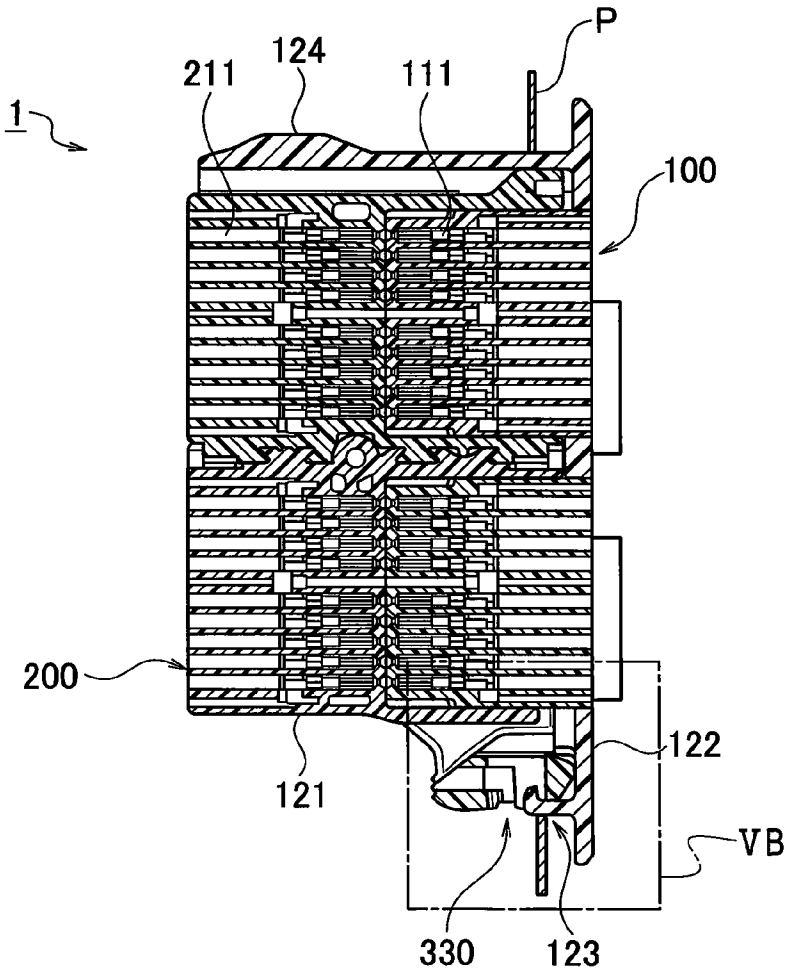
FIG. 5A is a cross-sectional view that illustrates a normal fitted state of the female connector and the male connector in the lever connector according to the exemplary embodiment of the present invention.

FIG. 5A is a cross-sectional view that illustrates the normal fitted state of the female connector 100 and the male connector 200 in the lever connector 1 according to the present embodiment. FIG. 5B is an enlarged view that illustrates an area VB in the vicinity of the locking portion 123 and the locked portion 330 in FIG. 5A. The lever connector 1 is attached to the attachment hole H formed on the panel P in the state where the female connector 100 and the male connector 200 have been fitted with each other.

In the partial fitted state of the female connector 100 and the male connector 200, as shown in FIGS. 4A and 4B, when the lever connector 1 is attached to the panel P, the locking portion 123 abuts on the hole edge (lower edge) of the attachment hole H formed on the panel P. In other words, the locking portion 123 abuts on the hole edge of the attachment hole H in a state where the locked portion 330 is not locked with the locking portion 123. Thereby, it is possible to detect the partial fitted state of the female connector 100 and the male connector 200.

In the case of the partial fitted state of the female connector 100 and the male connector 200 as shown in FIGS. 4A and 4B, it is considered that the locking portion 123 is prevented from abutting on the hole edge of the attachment hole H by displacing the lever connector 1 toward the upper side of the attachment hole H formed on the panel P. However, in this case, since the abutment portion 124 abuts on the hole edge (upper edge) of the attachment hole H, it is possible to detect the partial fitted state of the female connector 100 and the male connector 200.

In contrast, in the normal fitted state of the female connector 100 and the male connector 200, as shown in FIGS. 5A and 5B, the locking portion 123 gets over the locked portion 330 and is restored in the inward direction with respect to the rotation direction of the lever 300. Thereby, when the lever connector 1 is attached to the panel P, the locking portion 123 is prevented from abutting on the hole edge (lower edge) of the attachment hole H formed on the panel P. In other words, the locking portion 123 does not abut on the hole edge of the attachment hole H in the state where the locked portion 330 is locked with the locking portion 123. Then, the attachment hole H formed on the panel P is locked with the panel locks 121A, which allows the lever connector 1 to be attached to the panel P.

(3) Operations and Effects

In the present embodiment described above, the flange portion 122 is provided to one edge of the body portion 121. This prevents increase in the size of the lever connector 1 because it is not necessary to extend an interference portion outward with respect to the rotation direction of the lever 300 like a conventional one.

The locking portion 123 does not abut on the hole edge of the attachment hole H in the state where the locked portion 330 is locked with the locking portion 123, and the locking portion 123 abuts on the hole edge of the attachment hole H in the state where the locked portion 330 is not locked with the locking portion 123. That is, the locking portion 123 does not abut on the hole edge of the attachment hole H in the normal fitted state of the female connector 100 and the male connector 200, and the locking portion 123 abuts on the hole edge of the attachment hole H in the partial fitted state of the female connector 100 and the male connector 200. Thus, it is possible to detect the partial fitted state of the female connector 100 and the male connector 200, that is, it is possible to surely detect the fitted state of the female connector 100 and the male connector 200.

In the present embodiment, the bending part 123B is inserted in the insertion hole 331 of the lever 300. Thereby, the locked portion 330 is surely locked with the locking portion 123 in the normal fitted state of the female connector 100 and the male connector 200. Thus, it is possible to surely detect the fitted state of the female connector 100 and the male connector 200.

In the present embodiment, the abutment portion 124 is provided at the position different from that where the locking portion 123 is provided. Thereby, in addition to the detection of the partial fitted state of the female connector 100 and the male connector 200 by the abutment on the hole edge of the attachment hole H in the locking portion 123, it is also possible to detect the partial fitted state of the female connector 100 and the male connector 200 by the abutment on the hole edge of the attachment hole H in the abutment portion 124.

In the present embodiment, the locking portion 123 is formed at the position corresponding to the hole edge of the attachment hole H in the normal fitted state of the female connector 100 and the male connector 200. Thereby, when the female connector 100 and the male connector 200 are attached to the attachment hole H formed on the panel P, the hole edge of the attachment hole H prevents the locking portion 123 from bending toward the outward direction with respect to the rotation direction of the lever 300. This prevents the locking portion 123 from being separated from the hole edge of the attachment hole H.

(4) Other Embodiments

As described above, although the subject matter of the present invention is disclosed through the embodiment of the present invention, it should not be understood that the description and the drawing constituting a part of the disclosure limit the present invention. From the disclosure, various alternative embodiments, examples and operational techniques are obvious to a person skilled in the art.

For example, the embodiment of the present invention can be modified as follows. Specifically, although the embodiment describes that the female connector 100 includes the inner housing 110 and the frame 120 which are independently formed, the present invention is not limited to this. The inner housing 110 and the frame 120 may be integrally formed.

Although the embodiment describes that the lever 300 is provided to the female connector 100 (frame 120), the present invention is not limited to this. The lever 300 may be provided to the male connector 200.

Although the embodiment describes that the flange portion 122 includes the abutment portion 124, the present invention is not limited to this. The flange portion 122 may have a structure in which it does not include the abutment portion 124.

Thus, it is obvious that the present invention includes various modified embodiments which are not described here. Therefore, the technical scope of the present invention is defined only by the matters used to specify the invention in the claimed inventions which are valid with reference to the above-described explanation.

What is claimed is:

1. A lever connector to be attached to an attachment hole formed on a panel, comprising:

a first connector;

a second connector to be fitted with the first connector; and a lever that is provided to one of the first connector and the second connector and causes the first connector and the second connector to be fitted with each other by rotation thereof, wherein the lever connector is attached to the attachment hole formed on the panel in a state where the first connector and the second connector are fitted with each other, the first connector includes a housing and a frame that surrounds the housing, the frame includes a body portion and a flange portion that is provided to one edge of the body portion and protrudes toward a straight direction perpendicular to a direction in which the first connector and the second connector are to be fitted with each other, the flange portion is provided with a front surface located at a side of the body portion and includes a locking portion with flexibility, the lever includes a locked portion locked with the locking portion in a normal fitted state of the first connector and the second connector, and the locking portion does not abut on a hole edge of the attachment hole in a state where the locked portion is locked with the locking portion, and abuts on the hole edge of the attachment hole in a state where the locked portion is not locked with the locking portion.

2. The lever connector according to claim 1, wherein the locking portion includes:

a protruding part that protrudes toward a direction away from a side of the front surface of the flange portion; and a bending part that bends inward with respect to a rotation direction of the lever from a distal end of the protruding part, and an insertion hole in which the bending part is to be inserted is formed on the locked portion.

3. The lever connector according to claim 1, wherein the flange portion includes an abutment portion that abuts on the hole edge of the attachment hole in a partial fitted state of the first connector and the second connector, and the abutment portion is provided at a position different from a position at which the locking portion is provided.

* * * * *